US005545110A

United States Patent [19]

Hsiang

[11] Patent Number: 5,545,110

[45] Date of Patent: Aug. 13, 1996

[54] TRAMPOLINE

[76] Inventor: Hua-Lu Hsiang, No. 520-1, Sec. 2, Hai-Shan Rd., Hai-Hu Tsun, Lu-Chu Hsiang, Tao-Yuan Hsien, Taiwan

[21] Appl. No.: 377,994

[22] Filed: Jan. 25, 1995

[51] Int. Cl.[6] ..... A63B 5/08

[52] U.S. Cl. ..... 482/27; 482/28; 482/29

[58] Field of Search ..... 482/27, 51, 52, 482/27, 28, 29, 35, 36; 273/73 D; 256/45, 46; 52/239; 5/99.1, 100

[56] References Cited

U.S. PATENT DOCUMENTS 3,966,207 6/1976 Pass ..... 273/73 D 4,339,123 7/1982 Rich ..... 482/28

FOREIGN PATENT DOCUMENTS 2504875 8/1976 Germany ..... 482/27

*Primary Examiner*—Jerome Donnelly
*Attorney, Agent, or Firm*—Bacon & Thomas

[57] ABSTRACT

The jumping bed of a trampoline is secured to the trampoline frame by passing an elastic rubber cord through a plurality of channels spaced around the periphery of the bed and pulling portions of the cord outwardly from between adjacent channels to form loops which are attached to retainer rods spaced around the frame.

2 Claims, 4 Drawing Sheets

TRAMPOLINE

BACKGROUND OF THE INVENTION

1. Field of the Invention

The present invention relates to trampolines, and more particularly to an improvement in the jumping bed mounting structure of a trampoline.

2. Description of the Prior Art

A variety of trampolines have been disclosed in the market for performing acrobatic tumbling and jumping feats. These trampolines include two types, one using springs to attach the jumping bed to the frame, and the other using an elastic rubber cord to fasten the jumping bed to the frame. FIG. 1 shows a conventional trampoline of the former type. FIG. 2 shows a conventional trampoline of the latter type.

As illustrated in FIG. 1, a plurality of springs are fastened to respective hanging holes on the frame to hold the jumping bed. When installed, the springs must be provided with a covering to protect the legs of the user from being jammed in or injured by the springs. The arrangement of this protective covering greatly complicates the installation procedure and cost of the trampoline.

The trampoline shown in FIG. 2 uses an elastic rubber cord to attach the jumping bed to the frame. The elastic rubber cord is inserted through holes on the border of the jumping bed and wound around the border of the frame. The use of the elastic rubber cord to attach the jumping bed to the frame eliminates the aforesaid drawback. However, it is not easy to fasten the elastic rubber cord.

Furthermore, the aforedescribed two types of trampolines are commonly assembled at the factory because special techniques or tools are needed to fasten the jumping bed to the frame. However, the transportation cost is high when a trampoline is assembled at the factory.

SUMMARY OF THE INVENTION

The present invention provides a trampoline which eliminates the aforesaid drawbacks. It is one object of the present invention to provide a trampoline which may be assembled by the user. It is another object of the present invention to provide a trampoline which can be easily assembled by the consumer without the need of any special techniques or tools, so that it may be delivered in a collapsed condition to save transportation cost. It is still another object of the present invention to provide a trampoline which is safe to use.

According to the preferred embodiment of the present invention, the trampoline comprises six legs, an open frame consisting of plural pairs of frame rails connected to one another and respectively supported on the six legs, a jumping bed stretched within the open frame, and an elastic rubber cord hung on the open frame to hold the jumping bed within the open frame. The jumping bed has a plurality of channels spaced around the border through which the elastic rubber cord is inserted and pulled outwardly into a plurality of loops for hanging on the open frame. The open frame comprises a plurality of retainer rods for engagement by the loops of the elastic rubber cord, with each retainer rod having a projecting portion for maintaining each loop in place.

DETAILED DESCRIPTION OF THE PREFERRED EMBODIMENT

Figure 1:
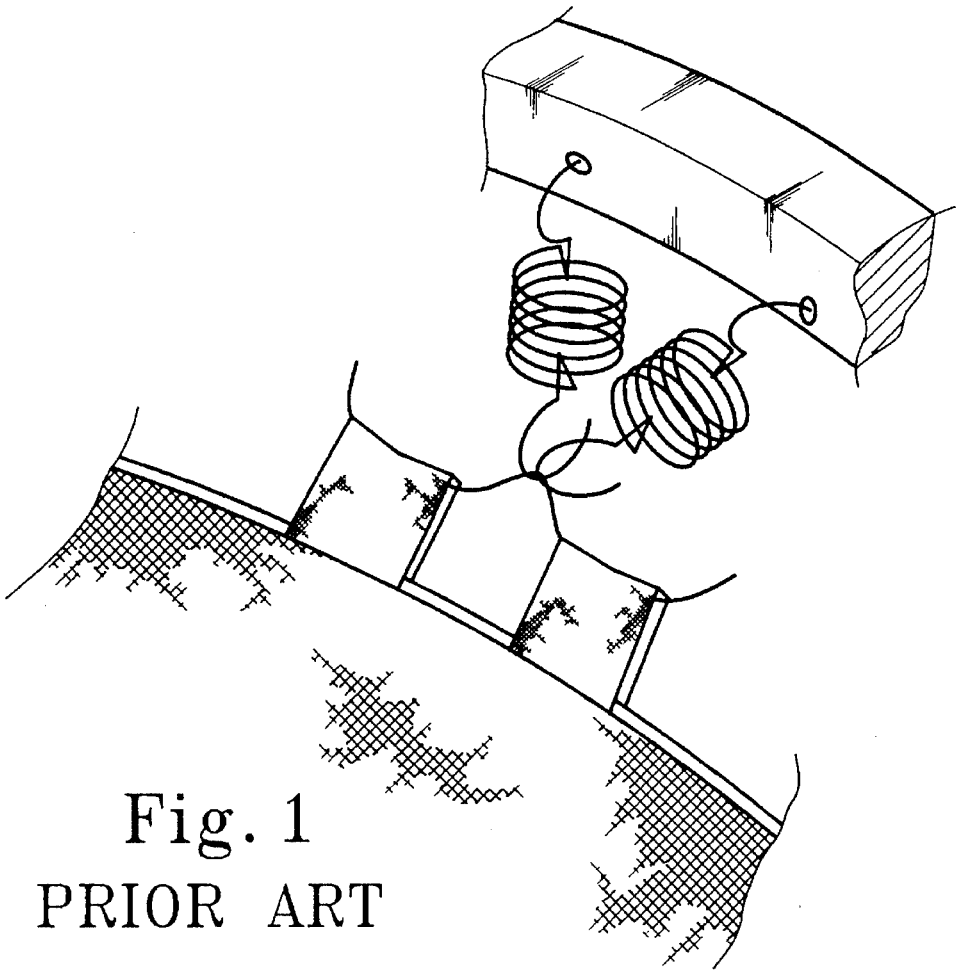
Fig. 1 PRIOR ART
FIG. 1 is a partial view of a first type of trampoline according to the prior art.
Figure 2:
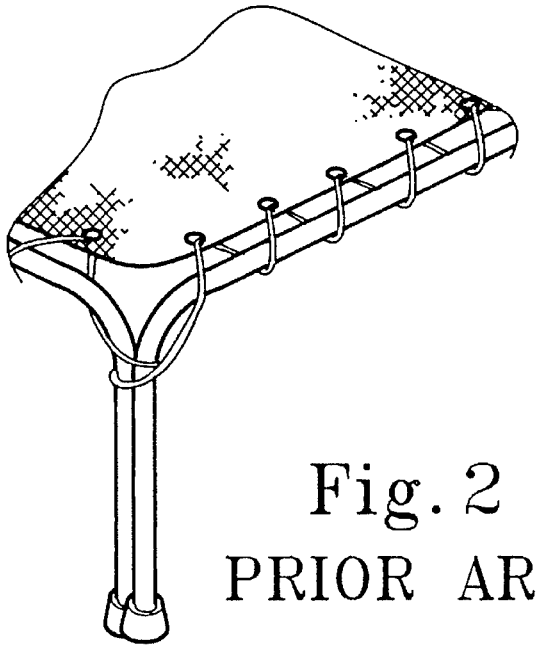
Fig. 2 PRIOR ART
FIG. 2 is a partial view of a second type of trampoline according to the prior art.
Figure 3:
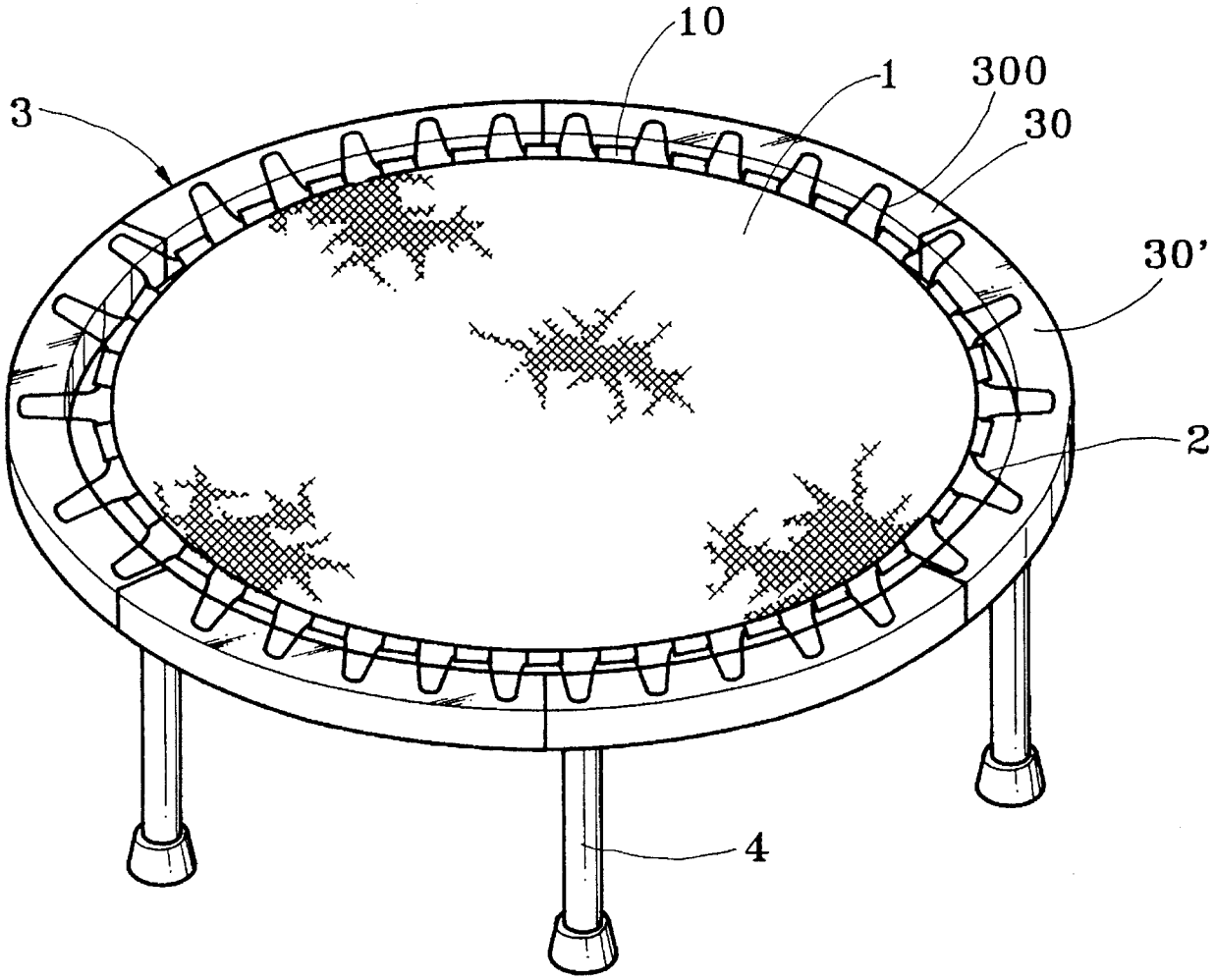
FIG. 3 is an elevational view of a trampoline according to the present invention.

Referring to FIG. 3, a trampoline in accordance with the present invention is generally comprised of six legs 4, an open frame 3 including three pairs of frame rails 30 and 30' respectively supported on the six legs 4, an elastic rubber cord 2, and a jumping bed 1 stretched within the open frame 3 by the elastic rubber cord 2. The jumping bed 1 has a plurality of channels 10 spaced around the periphery thereof and through which the elastic rubber cord 2 is inserted for fastening the jumping bed 1 to the open frame 3.

Figure 4:
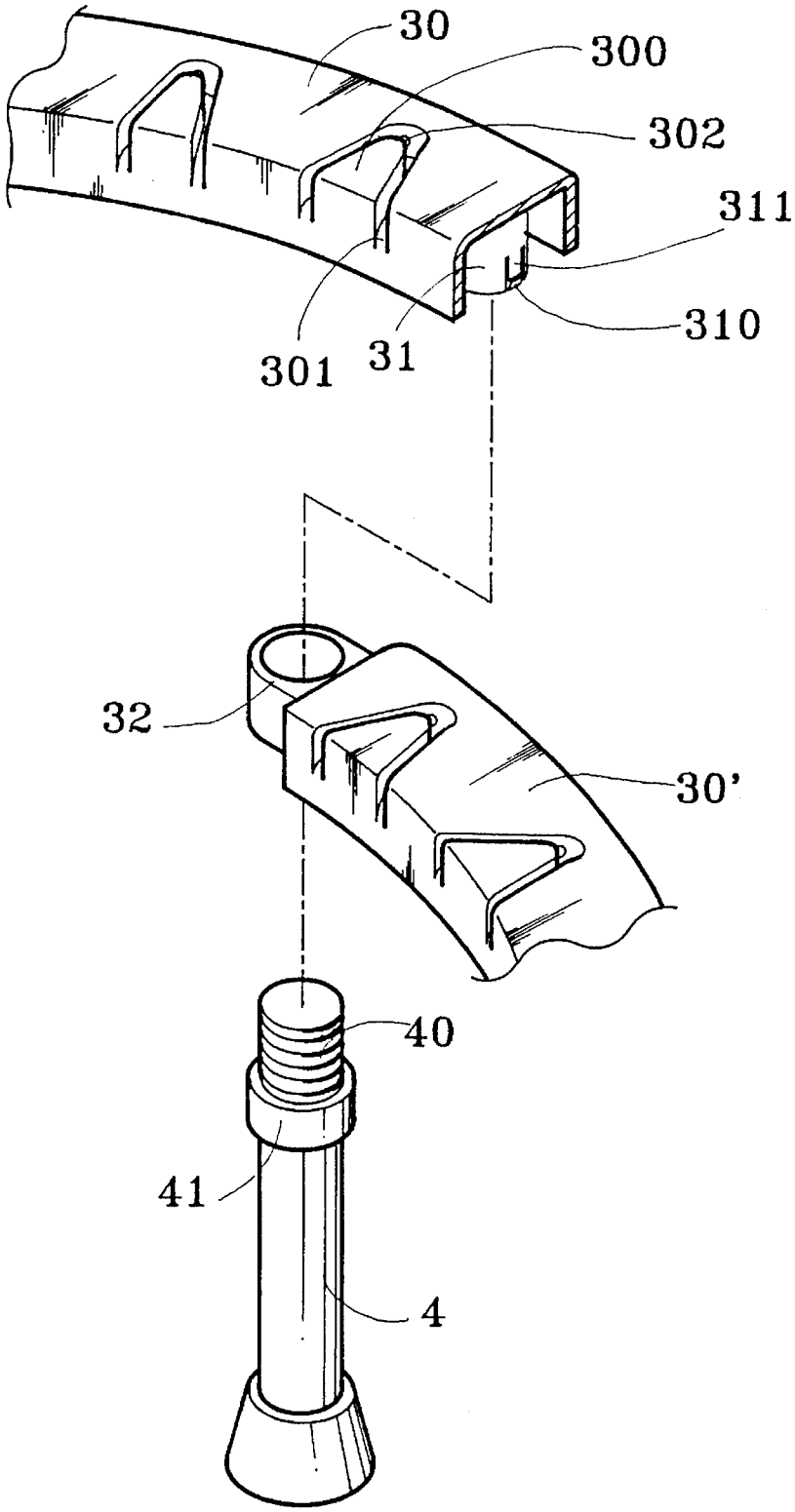
FIG. 4 is an exploded view of part of the trampoline shown in FIG. 3.

Referring to FIG. 4, each pair of frame rails 30 and 30' is comprised of a male frame rail 30 and a female frame rail 30', with each frame rail 30 or 30' having a plurality of smoothly curved recesses 301 spaced along the inner side thereof and a retainer rod 300 disposed in each smoothly curved recess 301 for hanging the elastic rubber cord 2.

Each retainer rod 300 has a projecting portion 302 which projects outwardly in the radial direction for maintaining the elastic rubber cord 2 in place after the elastic rubber cord 2 is hung on the retainer rod 300. The male frame rail 30 has a male connector 31 at each end. The female frame rail 30' has a female connector 32 at each end for connection to the male connector 31 at each end of the male frame rail 30. The male connector 31 includes an internally threaded split socket 311 comprised of a plurality of hooked portions 310. When the internally threaded split socket 311 is fitted into the female connector 32, the hooked portions 310 of the internally threaded split socket 311 are respectively hooked on the bottom edge of the female connector 32, and therefore the male frame rail 30 and the female frame rail 30' are firmly fastened together.

Referring to FIG. 4 again, each leg 4 has a threaded top portion 40 for threading into the internally threaded split socket 311 at each end of the male frame rail 30, and an outwardly extending peripheral flange 41 adjacent top portion 40, which flange 41 engages the bottom edge of the corresponding internally threaded split socket 311 below the corresponding female connector 32.

Figure 5B:
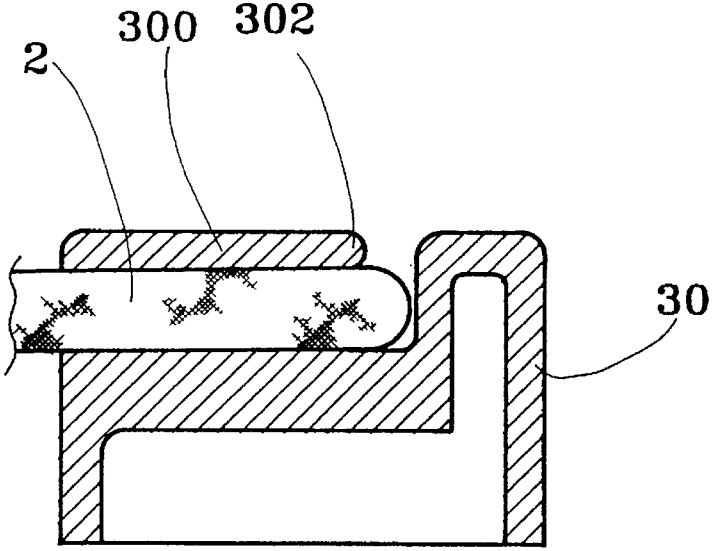
FIG. 5B is similar to FIG. 5A, but showing the elastic rubber cord hung on the retainer rod.
Figure 5A:
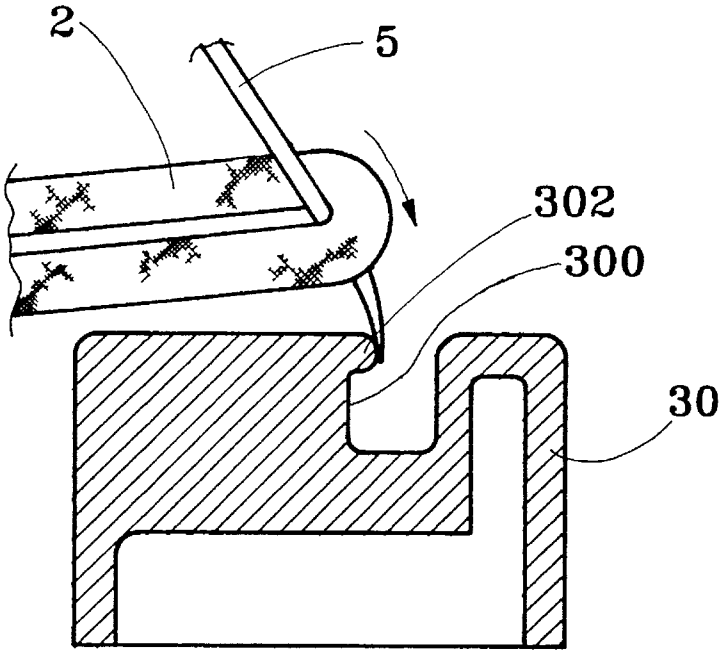
FIG. 5A is a partial view of the trampoline of the present invention, showing the elastic rubber cord stretched by a spanner.

Referring to FIGS. 5A and 5B, when the elastic rubber cord 2 is inserted through the channels 10 of the jumping bed 1, it may be pulled outwardly from between adjacent channels 10 to form a plurality of loops. A spanner is used to engage each loop of cord 2 and stretch same outwardly and into engagement around each retainer rod 300. This is facilitated by the tip of spanner 5 pivoting around the projecting portion 302 of rod 300. By repeating the aforesaid procedure with each loop, the elastic rubber cord 2 is fastened to the open frame 3 to stretch the jumping bed 1.

I claim:

1. A trampoline comprising:

a) an open frame formed by a plurality of pairs of frame rails matingly engaged together and a plurality of retainer rods spaced around the frame, each pair of frame rails including a male frame rail and a female frame rail, and each retainer rod including a projecting portion;

b) each male frame rail having a pair of opposite ends, each opposite end including a male connector defined by an internally threaded split socket having a plurality of hooked portions;

c) each female frame rail having a pair of opposite ends, each opposite end including a female connector having a bottom edge, with each male connector being fitted within each female connector and secured thereto by the hooked portions engaging the bottom edge of the female connector;

d) a plurality of legs supporting the open frame, each leg including a threaded top portion threadedly engaged within the internally threaded split socket of a male connector;

e) a jumping bed including a plurality of channels spaced around the periphery of the bed; and f) an elastic cord extending through the channels, with portions of the cord between adjacent channels being pulled outwardly to define a plurality of loops, and each loop being engaged on a retainer rod and maintained thereon by the projecting portion for stretching and attaching the jumping bed on the open frame.

2. The trampoline of claim 1 wherein the open frame further includes a plurality of smoothly curved recesses spaced around the frame and each retainer rod being disposed within a curved recess.

* * * * *